US005170593A

United States Patent [19]

Tyler et al.

[11] Patent Number: 5,170,593

[45] Date of Patent: Dec. 15, 1992

[54] METHOD OF MAKING A PERFORATED STRIP ABRASIVE TOOL

[75] Inventors: James B. Tyler, Westlake; Alfred F. Scheider, Orange; R. Brown Warner, Westlake, all of Ohio

[73] Assignee: Jason, Inc., Cleveland, Ohio

[21] Appl. No.: 670,566

[22] Filed: Mar. 18, 1991

[51] Int. Cl.[5] ..... B24B 9/02

[52] U.S. Cl. ..... 51/334; 51/337; 51/297

[58] Field of Search ..... 51/334, 337, 332, 331, 51/330, 297, 298; 300/5, 9

[56] References Cited

U.S. PATENT DOCUMENTS

| | | | |
|---|---|---|---|
| 2,259,475 | 10/1941 | Koether | 51/337 |
| 3,053,021 | 11/1962 | Block | 51/337 |
| 3,212,219 | 10/1965 | Gillett | 51/337 |
| 3,548,551 | 12/1970 | Block | 51/337 |
| 4,969,299 | 11/1990 | Block | 51/337 |

FOREIGN PATENT DOCUMENTS

| | | | |
|---|---|---|---|
| 935475 | 10/1973 | Canada | 300/5 |

*Primary Examiner*—M. Rachuba

*Attorney, Agent, or Firm*—Renner, Otto, Boisselle & Sklar

[57] ABSTRACT

An extruded plastic strip contains abrasive grains or minerals embedded homogeneously therein throughout is scored along the machine or extrusion axis direction, such scoring including elliptical or pointed perforations with the long axis or generally pointed ends aligned with the scoring and parallel to the machine or extrusion axis. The preferred plastic material is a 612 nylon, although other plastics may be employed. The material is heat workable, yet relatively stiff and can be used to form a wide variety of power driven abrasive tools. The present application also disclosed a rotary wheel type tool utilizing the perforated strip, and a method of making that tool using a gel type cyanoacrylate as an adhesive. With the strip of the present invention, rotary wheel tools as well as many other tools can economically be produced. In tool use, the strip fractures along the scoring and perforations to provide a tool having closely packed individual rectangular fingers, each with a major flat side facing the direction of rotation.

26 Claims, 2 Drawing Sheets

METHOD OF MAKING A PERFORATED STRIP ABRASIVE TOOL

DISCLOSURE

This invention relates generally as indicated to a perforated strip abrading element and an abrading tool and method of making such tool using such strip element.

RELATED APPLICATIONS

This application relates to certain improvements in the abrasive elements and abrasive tools disclosed in the application of James B. Tyler et al, Ser. No. 07/471,385 filed Jan. 29, 1990. The disclosure of such copending application is incorporated herein by reference.

BACKGROUND OF THE INVENTION

In such prior application there is disclosed an abrasive strip which comprises extruded nylon incorporating abrasive mineral or abrasive particulate matter homogeneously mixed therein throughout. The strip or tape of the prior application may be formed into a variety of useful abrading tools, particularly internal finishing tools. Some of the tools are formed by cutting the tape or strip to fit a variety of power drive arbors or hubs. Some of the tools are formed by heating the tape or strip followed by quenching to give the abrasive strip or elements a permanent desired curvature or configuration. In addition, the strip or tapes are scored in a manner to facilitate the handling of the strips or tapes to form various tools with the scoring being designed to promote fracture in operation of the tools so that the strip breaks apart in use into a plurality of rectangular fingers. The scoring of the strip is not easily accomplished so that controlled fracture results.

It has been discovered that the strip when extruded has a grain which extends in the direction of extrusion or along the extrusion machine axis. It has also been discovered that if the strip is scored parallel to the direction of extrusion it will fracture more readily, but fracture problems still, nonetheless, are encountered. It has also been discovered that the desired fracture may be obtained by incorporating in the scoring perforations of an elliptical or pointed configuration so that the fracture, in effect, takes place from one perforation to the next along the scoring lines.

In such prior application there is illustrated what might be termed a flap wheel made from such tape or strip. Conventionally, flap wheels are made from sandpaper flaps which are die cut to incorporate notches or holes by which the flaps are anchored into a hub. If desired, adhesive may be employed in addition to the mechanical anchor of the flap into the hub.

For rotary wheel brushes or other types of wheel tools, complex mechanical anchors are employed such as core wires about which the bristle material is folded. Such brushes are difficult and expensive to make and often require trimming at the tool face to provide a proper cylindrical work face.

SUMMARY OF THE INVENTION

The working element of the present invention is an extruded plastic strip which contains abrasive grains or minerals embedded homogeneously therein throughout and which is scored in the machine or extrusion direction axis, such scoring including elliptical or pointed perforations with the long axis or generally pointed ends aligned with the scoring and parallel to the machine or extrusion axis. The preferred plastic material is nylon, although other plastics may be employed. The material is heat workable, yet relatively stiff and can be used to form a wide variety of power driven abrasive tools such as shown in applicants' prior application Ser. No. 07/471,385, filed Jan. 29, 1990, entitled "Abrasive Tool and Method of Making".

The present invention also relates to a rotary wheel type tool utilizing the perforated strip, as well as a method of making that tool. With the strip of the present invention, rotary wheel tools can economically be produced. In tool use, the strip fractures along the scoring and perforations to provide a tool having closely packed individual rectangular fingers of uniform length, each with a major flat side facing the direction of rotation.

The rotary wheel tool of the present invention is made by providing an annular hub with an outwardly extending annular channel. At least one side wall of the channel is provided with lateral openings near the bottom. Dividers are inserted between the walls of the channel to define a sector and a measured bundle of equal length working elements or strips in accordance with the present invention are driven into the channel between the dividers to a position just above the lateral opening. After a measured amount of gel form cyanoacrylate instant adhesive is injected through the opening to fill the bottom of the channel, the bundle of elements is driven into the instant adhesive which, when cured, secures the bundle in the bottom of the channel. The dividers are repositioned to repeat the process at an adjacent segment of the tool until the tool is completed. A uniform abrasive wheel is thus formed quickly and economically and which does not require face trimming.

To the accomplishment of the foregoing and related ends the invention, then, comprises the features herein after fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENT

Figure 1:
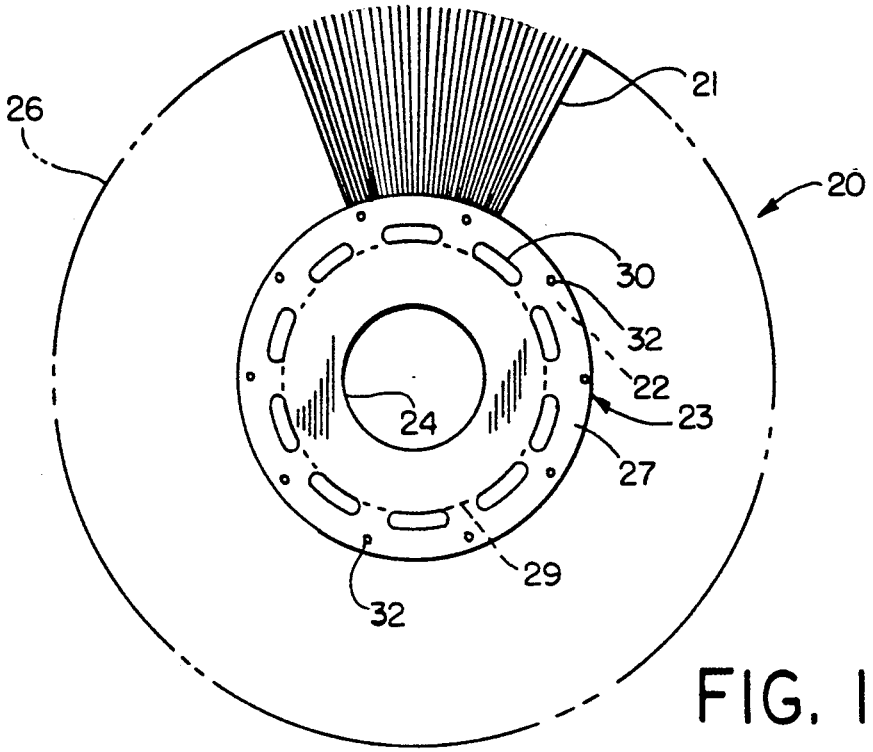
FIG. 1 is a transaxial elevation of a wheel tool in accordance with the present invention.

Referring initially to FIG. 1, there is illustrated a rotary wheel tool shown generally at 20 in accordance with the present invention. The tool comprises a large number or an array of working elements 21 projecting radially from channel 22 in hub 23. The hub is provided with a central hole 24 to enable it to be mounted on a power driven arbor for rotation. The working elements 21 project uniformly radially from the channel to form a tool having a circular work face 26.

Figure 3:
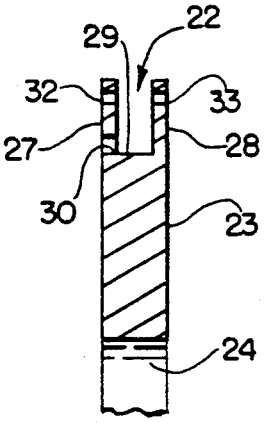
FIG. 3 is an enlarged radial section of the hub as seen from the line 3—3 of FIG. 2.
Figure 4:
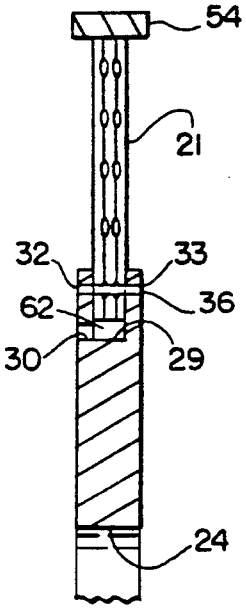
FIG. 4 is a radial section taken substantially on the line 4—4 of FIG. 2 illustrating a bundle of elements partially driven into the hub between dividers.

Referring additionally to FIG. 3, it will be seen that the outwardly opening channel 22 is formed of sidewalls 27 and 28 and a cylindrical bottom wall 29.

The sidewall 27 nearest the viewer in FIG. 1 is provided with a series of banana slots indicated at 30, the inner edges of which are contiguous or aligned with the bottom 29 of the channel 22. The slots 30 are slightly arcuate, hence the term "banana", following the bottom of the circular channel and are of equal length and circumferential spacing. In the embodiment of FIG. 1, there are 10 such slots, one centered for each 36° segment of the hub. Midway between adjacent slots at the outer end of the channel there is provided aligned holes seen at 32 and 33 in FIG. 3. There are thus 10 sets of aligned holes equally circumferentially spaced around the channel at the outer edge thereof. The holes define the 36° segments. Such holes are adapted to receive transverse guide pins 35 and 36 seen in FIGS. 2 and 4–7. The pins are utilized in the process of making the wheel tool but are not present in the finished tool.

It will be appreciated as the method of making the tool is described that the hub may be configured into smaller or larger segments. The segments may, for example, be eight in number, each being a segment of 45°.

Before describing the method of making the wheel tool, it will be seen that the working elements 21 are in the form of elongated strips and that the width of the channel is the same as the width of the strip.

Figure 8:
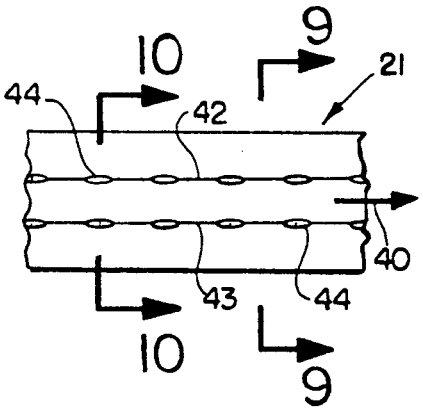
FIG. 8 is an enlarged fragmentary view of the perforated strip in accordance with the present invention.
Figure 9:
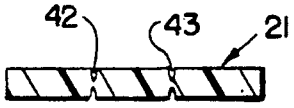
FIG. 9 is transverse section through the strip taken from the line 9—9 of FIG. 8.
Figure 11:
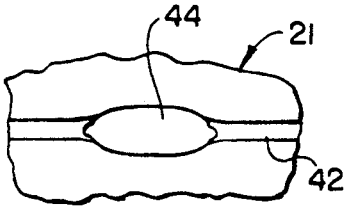
Figure 10:
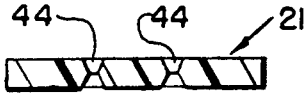
FIG. 10 is a transverse section taken from the line 10—10 of FIG. 8; and, FIG. 11 is an enlarged fragmentary illustration of the perforation which facilitates fracture in use along the scoring.

As seen in FIGS. 8, 9 and 10, the strip 21 may be extruded from a nylon plastic material and has abrasive grains or minerals embedded homogeneously therein throughout. The strip is extruded in the direction of the arrow 40 seen in FIG. 8. Although the dimensions of the strip or tape may vary widely, in the illustrated the embodiment the strip 21 is approximately 0.25 inches wide by 0.03 inches thick. The strip is scored in the machine or extrusion direction as indicated at 42 and 43 dividing the strip or tape longitudinally into three equal width sections. The scoring illustrated includes elliptical perforations seen at 44 which facilitate the splitting or fracture of the strip along such perforations. The perforations may be generally elliptical or have pointed ends as illustrated with the major axis or the points being aligned with the scoring. The perforations may be approximately 1 mm. wide and two mm. long. Since the material is extruded, the length of the working elements in the machine direction can be essentially indefinite and the extrusion is simply cut to length for the desired tool.

Figure 2:
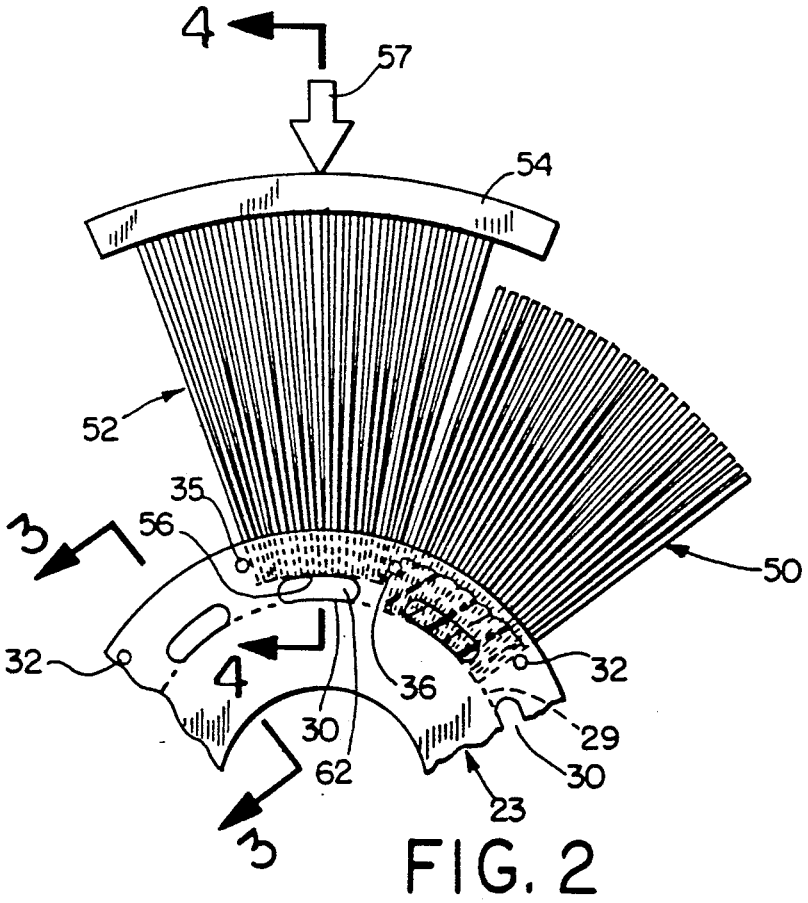
FIG. 2 is an enlarged fragmentary of such elevation illustrating the method of making the tool.

Referring now to FIG. 2, it will be seen that the circular array of working elements is formed one segment at a time. In FIG. 2 on the right hand side there is illustrated a segment of working elements shown generally at 50 secured in place in the channel. To the left of such segment 50 there is shown a segment of working elements 52 in the process of being inserted and secured in place. The process of inserting a bundle or segment or working elements is performed first by inserting a set of pins through the adjacent sets of holes in the channel walls as seen at 35 and 36, thus defining the segment within the channel.

Next a measured bundle of the working elements is formed or stacked major flat side to major flat side. One end of the bundle is pinched and inserted between the pins 35 and 36 and the other end is engaged by arcuate pusher 54 which drives the inner end of the bundle into the channel between the pins to the position seen in FIG. 2 and 4. In such position the inner end of the working elements is radially aligned with the outer edge of the banana slot 30 as indicated at 56. The arrow 57 indicates in FIG. 2 this initial movement of the bundle 52 with the lower or inner end of the bundle being wedged or driven between the two spaced pins 35 and 36 to the position shown. This is essentially the position seen in FIG. 4.

Figure 5:
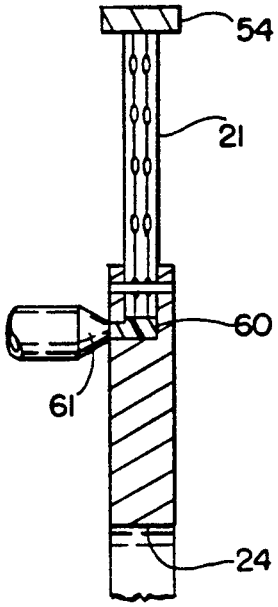
FIG. 5 is a view similar to FIG. 4 illustrating the adhesive being inserted into the lateral opening.

Referring now to FIG. 5, an instant cyanoacrylate adhesive seen at 60 is injected through the banana slot by the nozzle 61 filling the arcuate space 62 between the inner end of the elements and the bottom of the channel between the pins 35 and 36. This space is seen at 62 in FIGS. 2 and 4.

Figure 6:
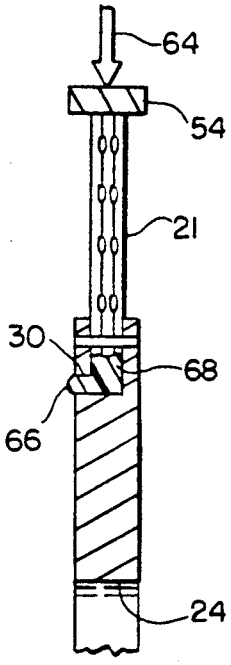
FIG. 6 is a view similar to FIG. 4 illustrating the elements being driven into the adhesive.
Figure 7:
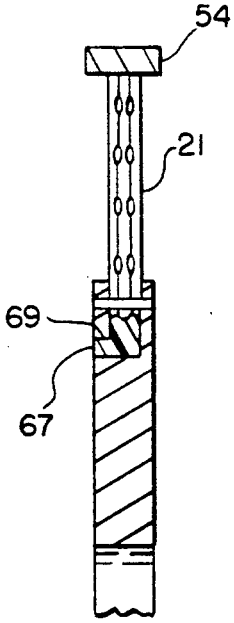
FIG. 7 is a view similar to FIG. 6 illustrating the elements seated in the channel.

Referring now to FIG. 6, with the nozzle removed, the pusher plate 54 is again driven downwardly as indicated by the arrow 64 to drive the bundle of working elements to the bottom of the channel and into the adhesive 60. The driving of the bundle causes excess adhesive to move outwardly through the slot 30 creating a slight bulge or drool 66. The preferred adhesive is a gel type cyanoacrylate and very quickly cures. After the adhesive cures, the excess adhesive projecting through the slot is removed to provide a smooth side face as seen at 67. The adhesive as the elements are driven into it, moves both by force and by capillary action upwardly along the sides of the working elements as seen at 68. When the adhesive cures it provides a block of rigid adhesive firmly securing the bundle of working elements to each other and to the channel. The adhesive projecting laterally through the slot provides an offset key 69 mechanically locking the bundle to the hub and properly seated within the channel. The method of the present invention utilizing the arcuate pusher 54 wedges the bundle in proper position at the bottom of the channel and avoids the requirement of trimming the tool face.

After the bundle 52 is driven into place, the pusher 54 is retracted and the hub is indexed to the next segment. The pin 3l is then removed and inserted in the holes 32 seen at the far left hand side of FIG. 2 and the process is repeated. When the hub is next again indexed, the pin 35 will be retracted, skipping to the pair of holes next beyond the holes at the far left side of FIG. 2. The process is repeated until the entire hub is completely filled to form the annular array of working elements.

As the tool is used, the working elements will fracture along the score lines 42 and 43 in effect dividing the strip into rectangular fingers, each having a major face approximately three times the thickness of the finger. The tool rotates in a direction to present the flat major face of each finger to the work.

While the dimensions of the working element may vary widely, the thickness of the working element may vary in the English system measurement from about 0.020 inches to approximately 0.05 inches, or preferably, as indicated, about 0.030 inches. The width may vary from approximately 0.010 inches to approximately 6 inches. Again, in the illustrated embodiment, the width is approximately 0.250 inches although substantially wider strips or tapes may be formed. The spacing of the scoring or perforations transversely of the machine direction is designed to provide a finger after fracture approximately three times as wide in its major face as it is thick.

As indicated, the preferred plastic for extrusion of the strip or tape working element is nylon. The preferred nylon is 612 nylon.

Nylons are long-chain partially crystalline synthetic polymeric amides (polyamides). Polyamides are formed primarily by condensation reactions of diamines and dibasic acids or a material having both the acid and amine functionality.

Nylons have excellent resistance to oils and greases, in solvents and bases. Nylons have superior performance against repeated impact, abrasion and fatigue. Other physical properties include a low coefficient of friction, high tensile strength, and toughness.

In general, the greater the amount of amide linkages, the greater the stiffness, the higher the tensile strength, and the higher the melting point. Several useful forms of nylon are available and include:

a) Nylon 6/6 synthesized from hexamethylenediamine (HMD) and adipic acid;

b) Nylon 6/9 synthesized from HMD and azelaic acid;

c) Nylon 6/10 synthesized from HMD and sebacic acid;

d) Nylon 6/12 synthesized from HMD and dodecanedioic acid;

e) Nylon 6 synthesized from polycaprolactam;

f) Nylon 11 synthesized from 11-aminoundecanoic acid;

g) Nylon 12 synthesized from polyaurolactam; and others.

Nylons useful in the present invention have Young's modulus greater than 0.05, preferably greater than 0.1 and preferably greater than 0.2. Young's modulus is defined as the amount of force the material can undergo without permanent deformation when the force is removed. This is a measure of elasticity of the relationship of stress or strain. The preferred nylon is nylon 6/12. The physical properties of 6/12 include a melting point of 212° C., a dry yield strength of $10^3$ psi of 8.8 (7.4 at 50% RH), a dry flexural modulus of 295 (180 at 50% RH). Nylon has a higher Young's modulus (0.040 $10^6$ psi) than rubber (0.01 at $10^6$ psi), which demonstrates the greater stiffness of nylon over an elastomer such as rubber, for example. As an example, a working element according to the present invention several feet long when held horizontally at one end at room temperature would show little or minimal deflection at the opposite end. Nylon is partially crystalline and hence has little or no rubbery regions during deformation. The degree of crystallinity determines the stiffness and yield point. As the crystallinity decreases the stiffness and yield stress decreases. Rubber, on the other hand, is an amorphous polymer and its molecular straightening leads to a low modulus of elasticity.

Nylon has a tensile strength of over 8000 psi, rubber, as an example, has a tensile strength of 300 psi. Nylon exhibits 250% breakage during elongation, rubber exhibits 1200%. Nylon has fair moisture resistance, yet rubber absorbs a large amount of water. Nylon has excellent resistance to oil and greases and other organic solvents, rubber has extremely poor resistance. Nylon retains its properties from −75° F. to 230° F., while rubber has a narrow range around room temperature. Nylon's increased strength, resistance to moisture and solvents, and its wide usable temperature range make it the preferred material for this construction.

Another type of polyamide useful in the present invention includes other condensation products with recurring amide groups along the polymer chain, such as aramids. Aramids are defined as a manufactured fiber in which at least 85% of the amide (—C(O)—N(H)—) linkages are attached directly to two aromatic hydrocarbon rings. This is distinguished from nylon which has less than 85% of the amide linkages attached directly to the two aromatic rings.

Aramid fibers are characterized by high tensile strength and high modulus. Two aramides that may be useful in the present invention include the polymerization of p-phenylenediamine with terephthaloyl chloride. The positioning of the groups on the aromatic rings tend to make this aramid a stiffer polymer. A less stiff polymer is formed from a m-phenyldiamine and isophthaloyl chloride. A meta substitution leads to more flexibility.

Aramids demonstrate a very strong resistance to solvents. Aramids have tensile strengths at 250° C. that are exhibited by textile fibers at room temperature.

Also, some thermoset polymers are useful. Polyesters are an example and are long chain synthetic polymers with at least 85% of a dihydric alcohol ester (HOROH) and terephthalic acid (p-$HOOCC_6H_4COOH$). Polyester fibers contain both crystalline and non-crystalline regions. Polyesters are resistant to solvents and demonstrate a breaking elongation of 19 to 40%.

Polyimides are polymers containing (CONHCO) and are also useful in the present invention. High temperature stability (up to 700° F.) and high tensile strength of 13,500 psi make polymides useful as binders in abrasive wheels.

The abrasive material may vary widely in amount, type and granular or grit size. For example, the abrasive material may range from aluminum oxide or silicon carbide to the more exotic polycrystalline diamond or cubic boron nitride. The abrasive may constitute from about 10% to about 50% by weight of the working element.

As an instant adhesive, it is preferred to employ a gel type cyanoacrylate of medium viscosity or medium fluidity. It is important that when the adhesive is applied to the bottom wall of the hub channel that it uniformly cover the bottom of the bundle and not run, yet have a controllable capillary action.

Useful with the present invention are alkyl cyanoacrylates having the formula:

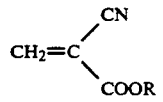

R = $CH_2$
$C_2H_5$
$C_3H_7$ etc.

A preferred cyanoacrylate adhesive is an alkoxy alkyl cyanoacrylate having the formula:

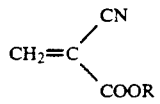

$$R = CH_3-O-C_2H_5 \quad C_2H_5-O-C_2H_5$$

Suitable gel type instant adhesives are available from Loctite Corporation of Newington, Connecticut under the trademark SUPERBONDER ®454 or the trademark BLACK MAX. SUPERBONDER is a registered trademark of Loctite Corporation. BLACK MAX is also a trademark of Loctite Corporation.

The wheel disclosed in this application may be run in either direction of rotation and in either direction of rotation, the major flat side of the fingers or working elements will be presented to the direction of rotation.

It is also noted that the working elements or flaps need not be punched or die cut with complex holes or notches to be manually assembled with similarly complex rings or hub parts.

The working elements of the present invention may also be used to produce a wide variety of tools, such as those shown in the aforenoted copending application. In any event, the perforations in combination with the scoring insure that the working elements fracture where intended during use and moreover, provide a sufficiently integral working element to facilitate the construction of a wide variety of tools such as the wheel disclosed.

Although the invention has been shown and described with respect to certain preferred embodiments, it is obvious that equivalent alterations and modifications will occur to others skilled in the art upon reading and understanding of the specification.

The present invention includes all such equivalent alterations and modifications, and is limited only by the scope of the following claims.

We claim:

1. A method of making a wheel tool comprising the steps of providing an annular hub having side walls, a bottom and an annular radially extending channel formed thereby, providing the sidewalls with aligned equally circumferentially spaced axially extending divider holes near the outer edge, and providing at least one side wall with lateral openings near the bottom of the channel, said openings being positioned circumferentially between adjacent divider holes, the divider holes and openings dividing the hub into equal sectors, inserting dividers in adjacent divider holes to define a sector within the channel, inserting a measured bundle of equal length fill material radially into said channel between said dividers so that the inner end of said bundle is radially above said lateral opening between said dividers, injecting a measured amount of gel form instant adhesive through said opening to fill the bottom of said channel circumferentially between said dividers and radially between the inner end of the bundle and the bottom of the channel, driving the bundle into the instant adhesive to secure the bundle within the channel as the adhesive cures, and repeating the process at each successive sector until the hub is filled.

2. A method as set forth in claim 1 including the step of removing one of the dividers and replacing it to the next sector to define such next sector between the replaced divider and the one not removed.

3. A method as set forth in claim 1 wherein said bundle is driven radially by an arcuate pusher to ensure that each fill element is driven to the bottom of the channel and to provide an arcuate tool face without trimming.

4. A method as set forth in claim 1 wherein said adhesive fills the lateral openings and when set, forms a laterally extending key locking each bundle in place.

5. A method as set forth in claim 1 wherein said bundle of fill material comprises a bundle of strips of non-elastomeric plastic having abrasive embedded therein homogeneously throughout.

6. A method as set forth in claim 5 wherein said strips have a length, width and thickness, the width being parallel to the axis of the tool.

7. A method as set forth in claim 6 wherein each strip is scored lengthwise.

8. A method as set forth in claim 7 wherein such scoring is designed to promote longitudinal fracture of the strip when the tool is in use.

9. A method as set forth in claim 7 wherein said scoring comprises a series of perforations extending longitudinally.

10. A method as set forth in claim 9 wherein each perforation includes a pointed end, the points extending in a direction to promote longitudinal fracture of the strip in use.

11. A method as set forth in claim 6 wherein said strips extend radially and have a width substantially the width of the channel whereby said tool is a flap wheel.

12. A method as set forth in claim 5 wherein said non-elastomeric plastic is nylon.

13. A method as set forth in claim 12 wherein said plastic contains from about 30 to about 50 per cent abrasive.

14. A method of making a wheel tool comprising the steps of providing an annular channel shape hub, including side walls and a bottom, dividing the channel into equal sectors providing a lateral slot in a sidewall at the bottom of the channel for each sector, inserting a measured bundle of fill material radially into said channel in one of said sectors so that the inner end of the bundle is radially above the lateral slot, injecting a measured amount of gel form instant adhesive through said slot to fill the bottom of the channel beneath the inner end of the bundle, driving the bundle into the instant adhesive to secure the bundle within the channel as the adhesive cures, indexing the hub and repeating the process at the adjacent sector until the hub is filled.

15. A method as set forth in claim 14 wherein said sectors are formed by dividers.

16. A method as set forth in claim 15 wherein said dividers are removable.

17. A method as set forth in claim 16 wherein said dividers are pins inserted in aligned pin holes in the walls of the channel near the outer edge.

18. A method as set forth in claim 14 wherein said bundle is driven radially by an arcuate pusher to ensure that each fill element is driven to the bottom of the channel and to provide an arcuate tool face without trimming.

19. A method as set forth in claim 14 wherein said adhesive fills the lateral slot and when set, forms a laterally extending key locking each bundle in place.

20. A method as set forth in claim 14 wherein said bundle of fill material comprises a bundle of strips of non-elastomeric plastic having abrasive embedded therein homogeneously throughout.

21. A method as set forth in claim 20 wherein said strips have a length, width and thickness, the width being parallel to the axis of the tool.

22. A method as set forth in claim 21 wherein each strip is scored lengthwise.

23. A method as set forth in claim 22 wherein such scoring is designed to promote longitudinal fracture of the strip when the tool is in use.

24. A method as set forth in claim 22 wherein said scoring comprises a series of perforations extending longitudinally.

25. A method as set forth in claim 21 wherein said strips extend radially and have a width substantially the width of the channel whereby said tool is a flap wheel.

26. A method as set forth in claim 20 wherein said non-elastomeric plastic is nylon.

* * * * *